US009437373B2

(12) United States Patent
Yi et al.

(10) Patent No.: US 9,437,373 B2
(45) Date of Patent: Sep. 6, 2016

(54) ON-OFF TRANSMISSION DEVICE FOR HIGH VOLTAGE ELECTRIC SWITCH

(71) Applicant: Xuchang Yongxin Electric Corporation Limited, Xuchang, Henan Province (CN)

(72) Inventors: Qinghai Yi, Xuchang (CN); Xiaomo Zhou, Xuchang (CN); Zhe Zhang, Xuchang (CN); Shouye Li, Xuchang (CN)

(73) Assignee: Xuchang Yongxin Electric Corporation Limited, Xuchang (CN)

( * ) Notice: Subject to any disclaimer, the term of this patent is extended or adjusted under 35 U.S.C. 154(b) by 0 days.

(21) Appl. No.: 14/373,317

(22) PCT Filed: Sep. 16, 2013

(86) PCT No.: PCT/CN2013/083538

§ 371 (c)(1),
(2) Date: Jul. 18, 2014

(87) PCT Pub. No.: WO2014/173064

PCT Pub. Date: Oct. 30, 2014

(65) Prior Publication Data

US 2015/0194275 A1 Jul. 9, 2015

(30) Foreign Application Priority Data

Apr. 22, 2013 (CN) ..... 2013 1 0140016

(51) Int. Cl.
*H01H 3/38* (2006.01)
*H01H 3/46* (2006.01)
(Continued)

(52) U.S. Cl.
CPC ..... *H01H 3/38* (2013.01); *H01H 1/502* (2013.01); *H01H 3/46* (2013.01); *H01H 3/58* (2013.01); *H01H 33/28* (2013.01); *H01H 2033/6667* (2013.01); *H01H 2235/02* (2013.01)

(58) Field of Classification Search
CPC ..... H01H 33/666; H01H 33/28; H01H 2033/6667; H01H 3/54; H01H 3/38; H01H 3/46; H01H 3/58; H01H 1/502
USPC ..... 218/118, 154, 155, 124; 200/144 B, 153
See application file for complete search history.

(56) References Cited

U.S. PATENT DOCUMENTS 3,511,944 A * 5/1970 Parks ..... H01H 33/666 200/17 R
3,727,019 A 4/1973 Harvey
(Continued)

FOREIGN PATENT DOCUMENTS

CN 101877290 A 11/2010
CN 101894703 A 11/2010
(Continued)

OTHER PUBLICATIONS

Machine translation CN 101894703 (Orig. doc. published Nov. 24, 2010).*
(Continued)

*Primary Examiner* — Renee Luebke
*Assistant Examiner* — William Bolton
(74) *Attorney, Agent, or Firm* — Locke Lord LLP; James E. Armstrong, IV; Howard M. Gitten

(57) ABSTRACT

The present invention provides a novel on-off transmission device for high voltage electric switch, comprising conducting rod and switch actuating device to actuate the reciprocating motion of the conducting rod, wherein an insulation layer is coated on the circumferential wall of the conducting rod. An insulation main shaft and an insulation crank arm rotate and swing to actuate the linear reciprocating motion of the conducting rod, and the contact compressing spring sheet is directly applied to the externally insulated conducting rod. Besides, the insulation portion is directly provided outside the conducting rod, which not only cuts down the cost of production, but also makes the overall structure compacted, simplified and miniaturized, and detachment and maintenance become more convenient.

9 Claims, 2 Drawing Sheets

(51) Int. Cl.

| | |
|---|---|
| ***H01H 3/58*** | (2006.01) |
| ***H01H 1/50*** | (2006.01) |
| ***H01H 33/666*** | (2006.01) |
| ***H01H 33/28*** | (2006.01) |

(56) References Cited

U.S. PATENT DOCUMENTS

| | | | | |
|---|---|---|---|---|
| 2002/0067230 | A1* | 6/2002 | Yoon | H01H 33/666 335/118 |
| 2011/0155697 | A1* | 6/2011 | Lee | H01H 33/022 218/140 |
| 2012/0276755 | A1* | 11/2012 | Sato | C10M 169/02 439/3 |

FOREIGN PATENT DOCUMENTS

| | | | |
|---|---|---|---|
| CN | 202178207 | U | 3/2012 |
| CN | 202549697 | U | 11/2012 |
| CN | 103219191 | A | 7/2013 |
| CN | 203192673 | U | 9/2013 |
| JP | S507271 | B1 | 3/1975 |
| JP | H07296687 | A | 11/1995 |

OTHER PUBLICATIONS

Chinese Search Report—CN201310140016.8 dated Oct. 25, 2014, English Translation.

Extended European Search Report dated Oct. 19, 2015 for EP13871309.4.

* cited by examiner

ON-OFF TRANSMISSION DEVICE FOR HIGH VOLTAGE ELECTRIC SWITCH

CROSS-REFERENCE TO RELATED APPLICATIONS

This application is the national phase under 35 U.S.C. §371 of PCT International Application No. PCT/CN2013/083538, filed Sep. 16, 2013, which claims the benefit of Chinese Patent Application No. 201310140016.8, filed Apr. 22, 2013, the entire contents of the aforementioned applications are hereby incorporated herein by reference.

FIELD OF THE INVENTION

The present invention relates to the field of high voltage switch of electric power, and, more particularly, to a novel on-off transmission device for high voltage electric switch.

DESCRIPTION OF THE PRIOR ART

In recent years, the development tendency of high voltage switches is to research and develop equipments for energy conservation and environment protection, with high reliability and little/without maintenance, and to concentrate on the technology and product of miniaturization, high capacity and common box type. Through years of research and development on high voltage switch actuators, the basic theory and structure thereof have been up to a new level. However, the transmission structure, conducting circuit and insulation structure of conventional switch are designed to be separated, which may cause the following limitations:

1) Although the breaking element of main circuit may be equipped with a little vacuum interrupter, yet the vacuum interrupter may be exposed to the atmosphere, leading to the requirement of insulation box or insulation barrier to realize interface and ground, which would make the configuration complicated and heavy, and make the process of manufacturing difficult and costly.

2) Conventional primary conducting circuit is composed of multi elements, including breaking moving contact, conductive clip, flexible connection, conductive rod and outlet terminal, so that primary conducting circuit with conductive clip, flexible connection and conductive rod would have complicated structure, high contact resistance, large heat generation and poor flow capacity, besides, since the limitation of the working shape of flexible connection, the electric-field distribution would be uneven, prone to produce overlarge local field strength, which would result in insulation puncture.

3) Conventional transmission portion, which may implement the high voltage isolation by the connection and transmission of insulated tension pole and conducting circuit as follows: ensuring the insulation capacity by the insulated tension pole to move the main shaft away from the primary conducting portion. Transmission system composed of two groups of swinging arm and insulated tension pole would have complicated transmission structure, too many parts and be tough in disassembly and debug.

SUMMARY OF THE INVENTION

The object of the present invention is to provide a novel on-off transmission device for high voltage electric switch, which can simplify primary conducting circuit and transmission mechanism, reduce the weight of switch and cut down the cost of high voltage electric switch.

The present invention adopts following technical schemes:

A novel on-off transmission device for high voltage electric switch, comprises conducting rod and switch actuating device to actuate the reciprocating motion of the conducting rod, and an insulation layer is disposed between the contact surface of the switch actuating device and the conducting rod.

The insulation layer is an insulation bushing covering the peripheral wall of the conducting rod, and one end of the conducting rod electrically connects to the breaking moving contact of the high voltage switch, while the other end thereof electrically connects to the respective outlet terminal of the high voltage switch corresponding to the breaking moving contact.

The device also has a contact spring to buffer and to maintain the contact pressure between the conducting rod and the breaking moving contact, and the contact spring is disposed at the end of the conducting rod which connects to the breaking moving contact.

The switch actuating device comprises actuator, transmission rod and actuating main shaft, and the actuator connects to one end of the transmission rod via an output crank arm, while the other end of the transmission rod connects to the end of the actuating main shaft via an input crank arm, and a double-eared fork arm is disposed on the actuating main shaft, and the actuating main shaft actuates the reciprocating motion of the conducting rod via the double-eared fork arm.

The conducting rod is coaxial with the outlet terminal of the moving contact of the high voltage switch, and there is a sliding electric connection between the conducting rod and the outlet terminal of the moving contact.

Between the insulation bushing and the conducting rod is tight fit, and the contact spring covers the outer surface of the insulation bushing, and a creepage extender is disposed on one end of the outer surface of the insulation bushing close to the breaking moving contact, and one end of the contact spring presses on the end of the creepage extender, while the other end thereof matches and connects to the double-eared fork arm via a sliding compressing spring sheet.

Between the insulation bushing and the conducting rod is sliding clearance fit, and the end of the insulation bushing close to the moving contact of the breaking element protrudes outward to become an insulation cover, the moving contact spring covers the conducting rod within the insulation cover, and one end of the contact spring is fixed to the end face of the insulation cover, while the other end thereof is fixed to a protruded limiting step on the conducting rod.

The double-eared fork arm has a cast insulation coating, and has an integral arc transition.

The present invention designs the conducting rod to be covered outside by a solid insulation layer, between the outlet terminals at both sides; one end of the insulated conducting rod is directly connected to the moving contact of the breaking element, while the other end thereof connected to the outlet terminal via a sliding conducting assembly with a slide (a flexible connection with conducting wire connected can also be used). An insulation main shaft and an insulation crank arm rotate and swing to actuate the linear reciprocating motion of the conducting rod, so that the use of redundant elements such as an insulated tension pole, a conducting clip and a flexible connection is avoided, and the contact compressing spring sheet is directly applied to the externally insulated conducting rod. Besides, the insulation portion is directly provided outside the conducting rod, which not only cuts down the cost of production, but also makes the overall structure compacted, simplified and miniaturized, and detachment and maintenance become more convenient.

DETAILED DESCRIPTION OF THE PREFERRED EMBODIMENTS

Figure 1:
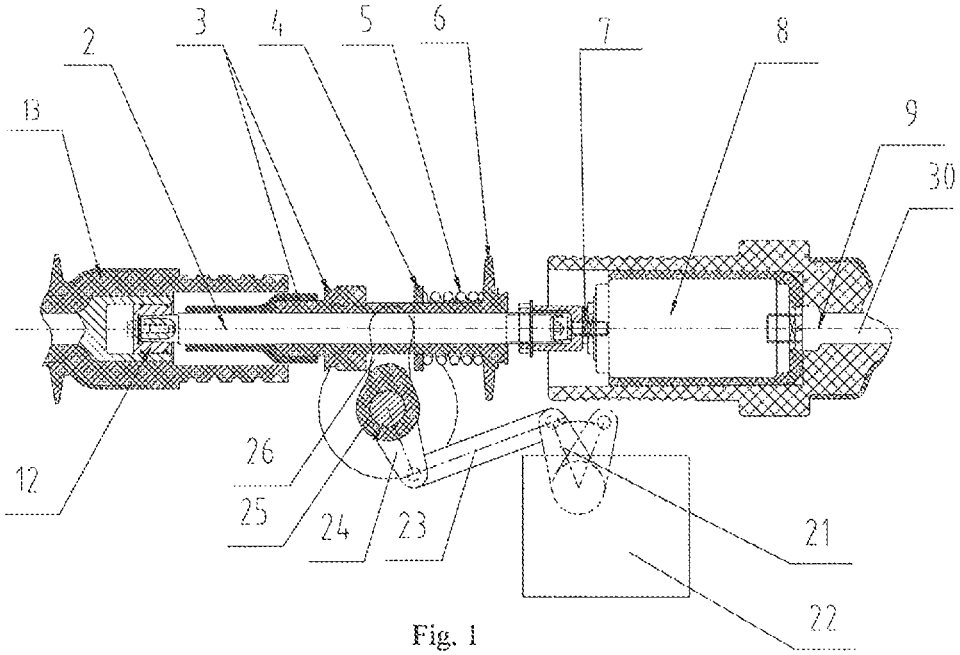
FIG. 1 is the structural representation of an embodiment according to the present invention.

Now refer to FIG. 1, a novel on-off transmission device for high voltage electric switch comprises a conducting rod 2 and an switch actuating device to actuate the reciprocating motion of the conducting rod 2, and an insulation layer is disposed between the contact surface of the switch actuating device and the conducting rod. The insulation layer is an insulation bushing 3 covering the peripheral wall of the conducting rod 2, and one end of the conducting rod 2 electrically connects to the breaking moving contact 7 of the high voltage switch, while the other end thereof electrically connects to the respective outlet terminal 13 of the high voltage switch corresponding to the breaking moving contact 7.

The device also has a contact spring 5 to buffer and to maintain the contact pressure between the conducting rod 2 and the breaking moving contact 7, and the contact spring 5 is disposed at the end of the conducting rod 2 which connects to the breaking moving contact 7.

The switch actuating device comprises an actuator 22, a transmission rod 23 and an actuating main shaft 25, and the actuator 22 connects to one end of the transmission rod 23 via an output crank arm 21, while the other end of the transmission rod 23 connects to one end of the actuating main shaft 25 via an input crank arm 24, and a double-eared fork arm 26 is disposed on the actuating main shaft 25, and the actuating main shaft 25 actuates the reciprocating motion of the conducting rod 2 via the double-eared fork arm 26.

Figure 3:
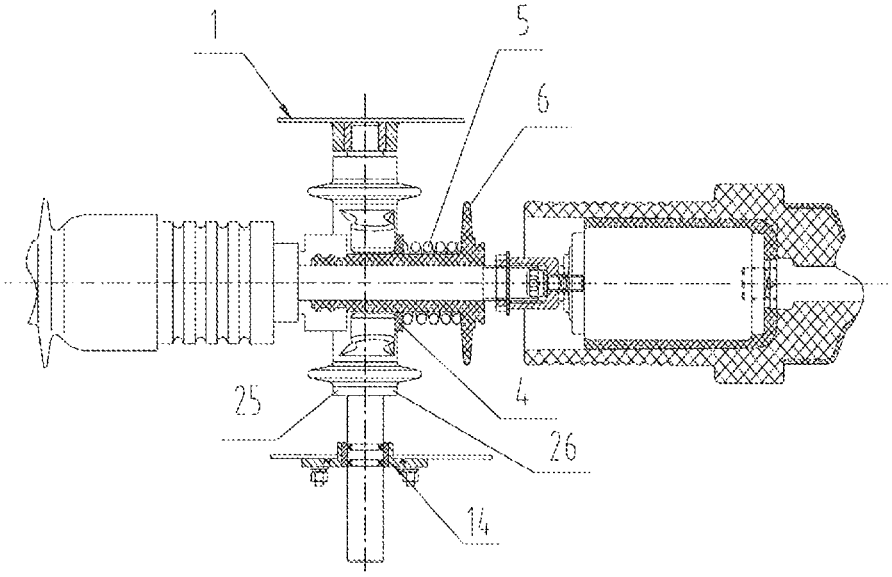
FIG. 3 is the vertical view of the embodiment according to the present invention in FIG. 1.

During installation of the device, as shown in FIG. 3, the switch actuating device is to be installed firstly. One end of the actuating main shaft 25 can be placed into a mounting hole 1 on the main shaft to fix the base (can be predetermined during the design of the house), while the other end thereof could be fixed by flange 14. The actuating main shaft 25 has a rigid metallic skeleton and external solid insulation coating structure, and the insulation layer is integrally cast by epoxy resin. The composition of epoxy can ensure not only the insulation capacity of the main shaft, but also the mechanical strength as the main transmission portion. In order to attain simple assembly and manufacturing, the double-eared fork arm 26 also has a cast insulation coating, and the integral arc transition can make the process of removing from the mold easier, and make the force applied on the corner more even. Since most conventional high voltage switches are common box type, insulation steps are added as required at the both sides of the double-eared fork arm 26, which can not only deliver the force, but also realize more reliable insulation effect and nice appearance of the insulation bushing 3.

Then the conducting rod 2 is to be installed: install the conducting rod 2 equipped with overstroke compressing spring sheet assembly (i.e. the contact spring 5 and the sliding compressing spring sheet 4) to one side of the double-eared fork arm 26 of the actuating main shaft 25 by tooling, and when the sliding compressing spring sheet 4 is equipped, there is no need to arrange insulation steps at the side where the sliding compressing spring sheet 4 set (the double-eared fork arm 26 directly acts on the sliding compressing spring sheet 4). The conducting rod 2 has a rigid conducting skeleton and externally solid insulation coating structure: the rigid conducting skeleton is a well-conducting conductor, and since the external coating is equipped with the sliding compressing spring sheet 4, the piecewise processing is utilized, so that the dimension of the mold can be reduced, the manufacturing can be more simple and the investing cost can be cut down; in particular, a section of external insulation layer may be cast on the skeleton of the conducting rod 2, wherein the insulation material should have good electric insulation, mechanical property and thermal stability, and the contact spring 5 and the sliding compressing spring sheet 4 may be placed on the external insulation layer, after that, another section of external insulation layer may be cast to enclose the overstroke compressing spring sheet assembly (i.e. the contact spring 5 and the sliding compressing spring sheet 4) into the certain dimension (depending on the stroke of various switches).

Lastly the outlet terminals at two sides, i.e. the inlet terminal 13 and the outlet terminal 30, are to be installed: fix the inlet terminal 13, the outlet terminal 30 and the breaking element 8 of the main circuit to the switch. The moving contact end of the breaking element of the main circuit is directly connected to the conducting rod 2, and the fixed contact end of the breaking element 8 of the main circuit is connected to the outlet terminal 30. Under the circumstance of the inlet terminal 13 and the conducting rod 2 being coaxial, the inlet terminal 13 and the conducting rod 2 would be on-state through the sliding electric connector 12; the sliding electric connector 12 is of little size, simple structure, easy to assemble and good electric conductivity, additionally, it can ensure the conduction direction of the linear reciprocating motion of the switch, and the sliding electric connecting is an ordinary bushing type electric connecting, which is regularly used in electric appliances, so the detailed connection and the working structure would be omitted herein. The sliding electric connector 12 can be replaced with any other element enabling the switch to accomplish the on-off stroke and adapting to the event of the inlet terminal 13 and the conducting rod 2 being uncoaxial (the central axes of the inlet terminal 13 and the conducting rod 2 are not on a line), such as flexible cord structure.

In embodiment 1, as shown in FIG. 1 and FIG. 3, between the insulation bushing 3 and the conducting rod 2 is rigid tight fit, the contact spring 5 covers the outer surface of the insulation bushing 3, and a creepage extender 6 is disposed on one end of the outer surface of the insulation bushing 3 close to the breaking moving contact 7, and one end of the contact spring 5 presses on the end of the creepage extender 6, while the other end thereof matches and connects to the double-eared fork arm 26 via the sliding compressing spring sheet 4.

In normal working condition, i.e. the high voltage switch is closed: the actuator 22 can store and release energy to the output crank arm 21, and the output crank arm 21 is connected to the input crank arm 24 of the actuating main shaft 25 of the switch actuating device via the transmission rod 23 and deliver the torque to the actuating main shaft 25, then the double-eared fork arm 26 of the actuating main shaft 25 turns to push the sliding compressing spring sheet 4 to bias to the contact compressing spring sheet 5 to compress the contact compressing spring sheet 5, delivering the pressure to the external insulation bushing 3 of the conducting rod connected to the breaking moving contact 7, so as to move the breaking moving contact 7 until the breaking moving contact 7 being close to the fixed contact 9 of the breaking element. This is the "on condition" of the switch.

When the switch is in its "off" condition, i.e. the high voltage switch is opened: similarly, the actuator 22 may provide the energy, and output crank arm 21 turns the transmission rod 23 and the actuating main shaft 25 of the switch actuating device to push the double-eared fork arm 26 of the actuating main shaft 25 to the step on the insulation layer at the other side, so as to move the conducting rod 2 and the breaking moving contact 7 to the other side to reach the "off condition" of the switch.

Figure 2:
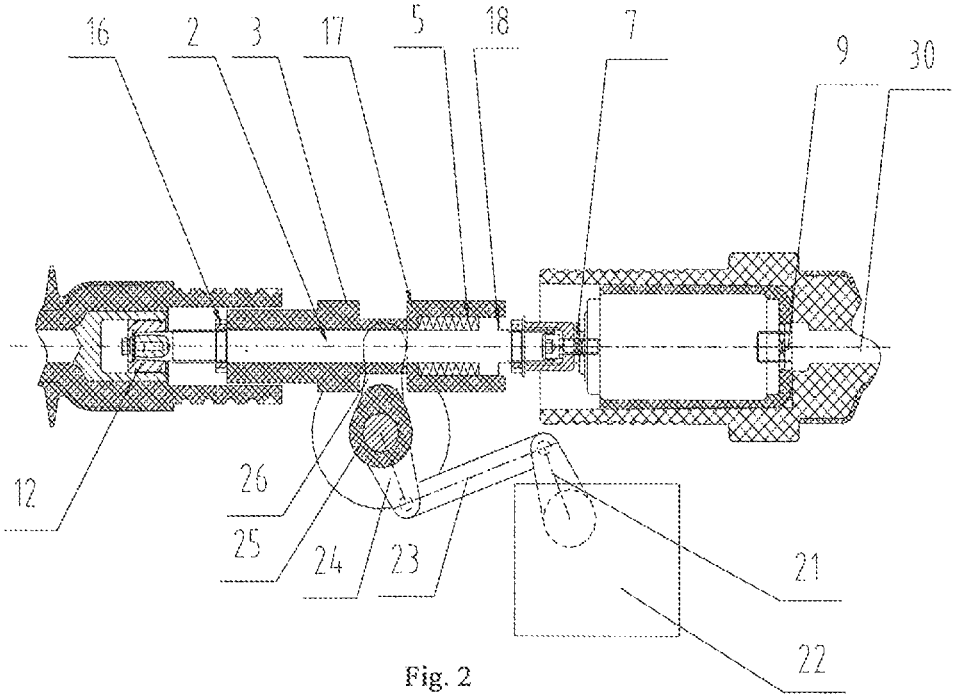
FIG. 2 is the structural representation of another embodiment according to the present invention.

In embodiment 2, as shown in FIG. 2, a sliding connection (clearance fit) is between the conducting rod 2 and the insulation bushing 3, and a limiting step 18 is disposed on the end of the conducting rod 2 contacted with the breaking moving contact 7, the contact spring 3 covers the conducting rod 2, and one end of the contact spring 5 is fixed to the limiting step 18 of the conducting rod 2, so as to completely put the contact spring 5 into the insulation bushing 3.

The insulation bushing 3 is molded by SMC composite plastic (have good electric insulation, mechanical property and thermal stability); place the contact spring 5 to the limiting step 18 for the contact spring of the conducting rod 2, then covers the insulation bushing 3 on the conducting rod 2, whose end is fixed to the contact pressure preconditioner 16, so that finish the fixture of the insulation bushing 3 and the contact spring 5. Now, since the contact spring 5 is disposed between the insulation bushing 3 and the conducting rod 2, a tube-shaped protruding insulation cover 17 may be formed on the insulation bushing 3 where the contact spring 5 is disposed, and the insulation cover 17 is a portion of the insulation bushing 3, in which disposed a fixed contact spring 5, and one end of the fixed contact spring 5 is fixed to the end face of the insulation cover 17, while the other end, thereof is fixed to the limiting step 18 of the conducting rod 2.

In normal working condition, i.e. the high voltage switch is closed: the actuator 22 can store and release energy to the output crank arm 21, and the output crank arm 21 is connected to the input crank arm 24 of the actuating main shaft 25 of the switch actuating device via the transmission rod 23 and deliver the torque to the actuating main shaft 25, then the double-eared fork arm 26 of the actuating main shaft 25 turns to press on the insulation step on the insulation bushing 3, so as to move the insulation bushing 3 to the breaking moving contact 7, and since one end of the contact compressing spring sheet 5 contacts with the insulation bushing 3, while the other end thereof is connected to the conducting rod 2, when the insulation bushing 3 moves, the contact compressing spring sheet 5 would compress to deliver the pressure to the external insulation bushing 3 of the conducting rod 2 connected to the breaking moving contact 7, so that the breaking moving contact would move until being close to the fixed contact 9 of the breaking element and maintain the pressure. This is the "on condition" of the switch.

When the switch is in its "off" condition, i.e. the high voltage switch is opened: similarly, the actuator 22 may provide the energy, and output crank arm 21 turns the transmission rod 23 and the actuating main shaft 25 of the switch actuating device to push the double-eared fork arm 26 of the actuating main shaft 25 to the step on the insulation layer at the other side, the insulation bushing 3 would move away from the breaking moving contact 7, and the contact compressing spring sheet 5 would release the pressure, so as to move the conducting rod 2 and the breaking moving contact 7 to the other side to reach the "off condition" of the switch. The length of the conducting rod in the present invention should meet the requirement of providing sufficient dimension for elements installation and transmission connection, and the requirement of the sum of the on-off stroke of the high voltage switch, yet the specific value of the length would depend on the size and dimension of the high voltage switch. The thickness of the insulation layer should assure necessary mechanical strength, while assure sufficient insulation capacity not to be punctured under the high voltage field strength.

The present invention realizes the on/off shift of the switch by the way of directly connecting the switch actuating device to the actuating conductive main circuit, while removing the ordinary insulated tension pole, so that the connection transmission structure would be novel, the assembly and disassembly would be simple, the occupied space would be compact and the structure would be smaller. Moreover, the main conductive circuit slidably connects to the outlet terminal via the insulated conducting rod and to the sliding electric connector, while removing the sectional connection of the main circuit and reducing the transitional elements such as flexible connection and conducting clip, which would bring better conductive capacity, more even electric field distribution and lower cost. Further, the unique design such as directly covering the contact spring structure on the primary conductive circuit, would save space, avoid transitional connection and make the device more stable and reliable.

The present invention is not limited to the embodiments discussed above, for instance, as long as the relationship between the conducting 2 and the parts driving the conducting rod to translate is an insulation coordination, such as the conducting rod 2 not be covered by the insulation bushing 3, but the outer surface of the double-eared fork arm 26 cast by insulation coating or directly, the double-eared fork arm 26 made of insulation material, otherwise, the swing structure of the double-eared fork arm 26 driving the conducting rod 2 to translate could also be replaced with a translation structure, such variants and modifications would still be within the scope of the present invention.

The invention claimed is:

1. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is tight fit, and the contact spring covers an outer surface of the insulation bushing, and a creepage extender is disposed on one end of the outer surface of the insulation bushing close to the breaking moving contact, and one end of the contact spring presses on one end of the creepage extender, while the other end thereof matches and connects to the double-eared fork arm via a sliding compressing spring sheet.

2. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is sliding clearance fit, and one end of the insulation bushing close to the breaking moving contact protrudes outward to become an insulation cover, the moving contact spring covers the conducting rod within the insulation cover, and one end of the contact spring is fixed to an end face of the insulation cover, while the other end thereof is fixed to a protruding limiting step on the conducting rod.

3. The on-off transmission device for high voltage electric switch of claim 2, wherein the double-eared fork arm has a cast insulation coating, and has an integral arc transition.

4. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the insulation layer is an insulation bushing covering peripheral wall of the conducting rod, and one end of the conducting rod electrically connects to a breaking moving contact of a high voltage switch, while the other end thereof electrically connects to an outlet terminal of the high voltage switch corresponding to the breaking moving contact; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is tight fit, and the contact spring covers an outer surface of the insulation bushing, and a creepage extender is disposed on one end of the outer surface of the insulation bushing close to the breaking moving contact, and one end of the contact spring presses on one end of the creepage extender, while the other end thereof matches and connects to the double-eared fork arm via a sliding compressing spring sheet.

5. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the insulation layer is an insulation bushing covering peripheral wall of the conducting rod, and one end of the conducting rod electrically connects to a breaking moving contact of a high voltage switch, while the other end thereof electrically connects to an outlet terminal of the high voltage switch corresponding to the breaking moving contact; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is sliding clearance fit, and one end of the insulation bushing close to the breaking moving contact protrudes outward to become an insulation cover, the moving contact spring covers the conducting rod within the insulation cover, and one end of the contact spring is fixed to an end face of the insulation cover, while the other end thereof is fixed to a protruding limiting step on the conducting rod.

6. The on-off transmission device for high voltage electric switch of claim 5, wherein the double-eared fork arm has a cast insulation coating, and has an integral arc transition.

7. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the insulation layer is an insulation bushing covering peripheral wall of the conducting rod, and one end of the conducting rod electrically connects to a breaking moving contact of a high voltage switch, while the other end thereof electrically connects to an outlet terminal of the high voltage switch corresponding to the breaking moving contact; further comprising a contact spring to buffer and to maintain contact pressure between the conducting rod and the breaking moving contact, and the contact spring is disposed at one end of the conducting rod which connects to the breaking moving contact; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is tight fit, and the contact spring covers an outer surface of the insulation bushing, and a creepage extender is disposed on one end of the outer surface of the insulation bushing close to the breaking moving contact, and one end of the contact spring presses on one end of the creepage extender, while the other end thereof matches and connects to the double-eared fork arm via a sliding compressing spring sheet.

8. An on-off transmission device for high voltage electric switch, comprising a conducting rod and a switch actuating device to actuate reciprocating motion of the conducting rod, wherein an insulation layer is disposed between contact surface of the switch actuating device and the conducting rod; wherein the insulation layer is an insulation bushing covering peripheral wall of the conducting rod, and one end of the conducting rod electrically connects to a breaking moving contact of a high voltage switch, while the other end thereof electrically connects to an outlet terminal of the high voltage switch corresponding to the breaking moving contact; further comprising a contact spring to buffer and to maintain contact pressure between the conducting rod and the breaking moving contact, and the contact spring is disposed at one end of the conducting rod which connects to the breaking moving contact; wherein the switch actuating device comprises an actuator, a transmission rod and an actuating main shaft, and the actuator connects to one end of the transmission rod via an output crank arm, while the other end of the transmission rod connects to one end of the actuating main shaft via an input crank arm, and a double-eared fork arm is disposed on the actuating main shaft, and the actuating main shaft actuates reciprocating motion of the conducting rod via the double-eared fork arm; wherein the conducting rod is coaxial with an outlet terminal of a moving contact of the high voltage switch, and there is a sliding electric connection between the conducting rod and the outlet terminal of the moving contact; wherein between the insulation bushing and the conducting rod is sliding clearance fit, and one end of the insulation bushing close to the breaking moving contact protrudes outward to become an insulation cover, the moving contact spring covers the conducting rod within the insulation cover, and one end of the contact spring is fixed to an end face of the insulation cover, while the other end thereof is fixed to a protruding limiting step on the conducting rod.

9. The on-off transmission device for high voltage electric switch of claim 8, wherein the double-eared fork arm has a cast insulation coating, and has an integral arc transition.

* * * * *